US008459533B2

(12) United States Patent
Requena et al.

(10) Patent No.: US 8,459,533 B2
(45) Date of Patent: Jun. 11, 2013

(54) CARTON WITH HANDLE

(75) Inventors: Emili Requena, Barcelona (ES); Ana Gonzalez, Barcelona (ES)

(73) Assignee: Graphic Packaging International, Inc., Marietta, GA (US)

( * ) Notice: Subject to any disclaimer, the term of this patent is extended or adjusted under 35 U.S.C. 154(b) by 576 days.

(21) Appl. No.: 12/711,550

(22) Filed: Feb. 24, 2010

(65) Prior Publication Data

US 2010/0213249 A1 Aug. 26, 2010

Related U.S. Application Data

(60) Provisional application No. 61/208,463, filed on Feb. 24, 2009.

(51) Int. Cl.
*B65D 5/46* (2006.01)

(52) U.S. Cl.
USPC ..... 229/117.12; 229/117.13

(58) Field of Classification Search
USPC ..... 229/117.12, 117.13, 117.14; 206/141, 206/427
See application file for complete search history.

(56) References Cited

U.S. PATENT DOCUMENTS

| | | | |
|---|---|---|---|
| 1,253,193 | A | 1/1918 | Hill |
| 2,383,183 | A | 8/1945 | Fishcher |
| 2,594,376 | A | 4/1952 | Arneson |
| 3,127,720 | A | 4/1954 | Gentry et al. |
| 2,702,144 | A | 2/1955 | Forrer |
| 2,797,856 | A | 7/1957 | Jaeschke |
| 2,810,506 | A | 10/1957 | Kessler |
| 2,819,506 | A | 10/1957 | Kessler |
| 2,868,433 | A | 1/1959 | Anderson, Jr. |
| 2,955,739 | A | 10/1960 | Collura |
| 3,112,856 | A | 12/1963 | MacIntosh et al. |
| 3,204,815 | A | 9/1965 | Weis |
| 3,309,005 | A | 3/1967 | Pilger |
| 3,334,767 | A | 8/1967 | Cornelius et al. |
| 3,355,012 | A | 11/1967 | Weiss |

(Continued)

FOREIGN PATENT DOCUMENTS

| | | |
|---|---|---|
| CA | 877792 | 8/1971 |
| CA | 2 160 145 | 9/1995 |

(Continued)

OTHER PUBLICATIONS

Notification of Reason for Refusal for JP 2008-557390 dated Feb. 13, 2012 and English Translation.

(Continued)

*Primary Examiner* — Gary Elkins
(74) *Attorney, Agent, or Firm* — Womble Carlyle Sandridge & Rice, LLP

(57) ABSTRACT

A carton for containing a plurality of articles. The carton comprises a first top panel, a second top panel, a bottom panel, a first side panel, and a second side panel. A handle comprises a first handle panel and a second handle panel. The first handle panel comprises a central portion in the top panel and an end portion in a first top end flap. The second handle panel comprises a first portion in the second top panel and a second portion in a second top end flap. The central portion of the first handle panel is attached to the first portion of the second handle panel and the end portion of the first handle panel is attached to the second portion of the second handle panel.

26 Claims, 4 Drawing Sheets

U.S. PATENT DOCUMENTS 3,381,881 A 5/1968 Granz et al.
3,828,926 A 8/1974 Rossi
3,886,901 A 6/1975 Zeitter
3,894,681 A 7/1975 Arneson et al.
3,904,036 A 9/1975 Forrer
3,933,303 A 1/1976 Kirby, Jr.
3,994,432 A 11/1976 Kirby, Jr.
4,029,204 A 6/1977 Manizza
4,036,423 A 7/1977 Gordon
4,096,985 A 6/1978 Wood
4,111,306 A 9/1978 Roccaforte
4,216,861 A 8/1980 Oliff
4,318,474 A 3/1982 Hasegawa
4,328,923 A 5/1982 Graser
4,329,923 A 5/1982 Iida
4,331,289 A 5/1982 Killy
4,364,509 A 12/1982 Holley et al.
4,375,258 A 3/1983 Crayne et al.
4,378,905 A 4/1983 Roccaforte
4,382,505 A 5/1983 Sutherland et al.
4,396,143 A 8/1983 Killy
4,418,864 A 12/1983 Nielsen
4,424,901 A 1/1984 Lanier
4,440,340 A 4/1984 Bakx
4,478,334 A 10/1984 Graser
4,498,619 A 2/1985 Roccaforte
4,508,258 A 4/1985 Graser
4,538,759 A 9/1985 Dutcher
4,545,485 A 10/1985 Oliff
4,546,914 A 10/1985 Roccaforte
4,577,799 A 3/1986 Oliff
4,588,084 A 5/1986 Holley, Jr.
4,653,686 A 3/1987 Wood et al.
4,706,876 A 11/1987 Wilson
4,747,487 A 5/1988 Wood
4,784,266 A 11/1988 Chaussadas
4,784,316 A 11/1988 Crouch
4,802,583 A 2/1989 Calvert et al.
4,830,267 A 5/1989 Wilson
4,875,586 A 10/1989 Chaussadas
4,966,324 A 10/1990 Steel
5,020,337 A 6/1991 Krieg
5,060,792 A 10/1991 Oliff
5,072,876 A 12/1991 Wilson
5,094,359 A 3/1992 DeMars et al.
5,106,014 A 4/1992 Miller
5,119,985 A 6/1992 Dawson et al.
5,197,598 A 3/1993 Stout et al.
5,221,041 A 6/1993 Stout et al.
5,222,658 A 6/1993 DeMaio et al.
5,234,102 A 8/1993 Schuster et al.
5,246,112 A 9/1993 Stout et al.
5,284,294 A 2/1994 Floyd
5,292,058 A 3/1994 Zoss et al.
5,297,725 A 3/1994 Sutherland
5,303,863 A 4/1994 Arasim
5,307,932 A 5/1994 Stout et al.
5,307,986 A 5/1994 Schuster
5,320,277 A 6/1994 Stout et al.
5,328,081 A 7/1994 Saulas
5,333,734 A 8/1994 Stout et al.
D350,480 S 9/1994 Sutherland
5,379,944 A 1/1995 Stout et al.
5,381,891 A 1/1995 Harris
5,385,234 A 1/1995 Stout et al.
5,395,044 A 3/1995 Stout
5,427,241 A 6/1995 Sutherland
5,458,234 A 10/1995 Harris
5,472,090 A 12/1995 Sutherland
5,485,915 A 1/1996 Harris
5,495,727 A 3/1996 Strong et al.
5,524,756 A 6/1996 Sutherland
5,551,556 A 9/1996 Sutherland
5,582,343 A 12/1996 Dalvey
5,639,017 A 6/1997 Fogle
5,647,483 A 7/1997 Harris
5,669,500 A 9/1997 Sutherland
5,699,957 A 12/1997 Bin et al.
5,704,470 A 1/1998 Sutherland
5,738,273 A 4/1998 Auclair
5,739,273 A 4/1998 Engelman et al.
5,794,778 A 8/1998 Harris
5,826,782 A 10/1998 Stout
5,873,515 A 2/1999 Dunn et al.
5,878,946 A 3/1999 Frerot et al.
5,906,313 A 5/1999 Oliff
5,915,546 A 6/1999 Harrelson
5,992,733 A 11/1999 Gomes
6,019,276 A 2/2000 Auclair
6,021,897 A 2/2000 Sutherland
6,065,590 A 5/2000 Spivey
6,085,969 A 7/2000 Burgoyne
6,105,853 A 8/2000 Lamare
6,105,854 A 8/2000 Spivey et al.
6,112,977 A 9/2000 Sutherland et al.
6,129,266 A 10/2000 Oliff et al.
6,131,803 A 10/2000 Oliff et al.
6,164,526 A 12/2000 Dalvey
6,170,741 B1 1/2001 Skolik et al.
6,227,367 B1 5/2001 Harrelson et al.
6,260,755 B1 7/2001 Bates et al.
6,302,320 B1 10/2001 Stout
6,371,365 B1 4/2002 Doucette et al.
6,425,520 B1 7/2002 Peterson
6,523,739 B2 2/2003 Heeley et al.
6,536,656 B2 3/2003 Auclair et al.
6,631,803 B2 10/2003 Rhodes et al.
6,758,337 B2 7/2004 Chargueraud et al.
6,766,940 B2 7/2004 Negelen
6,834,793 B2 12/2004 Sutherland
6,848,573 B2 2/2005 Gould et al.
6,869,009 B2 3/2005 Sutherland et al.
6,899,221 B2 * 5/2005 Skolik et al. ..... 206/141
6,905,066 B2 6/2005 Holley
6,926,193 B2 8/2005 Smalley
6,945,450 B2 9/2005 Rusnock
6,968,992 B2 11/2005 Schuster
7,007,836 B2 * 3/2006 Smalley ..... 229/117.13
7,234,596 B2 6/2007 Lebras
7,296,731 B2 11/2007 Auclair et al.
7,380,701 B2 6/2008 Fogle et al.
7,416,109 B2 8/2008 Sutherland
7,427,010 B2 9/2008 Sutherland
7,472,791 B2 1/2009 Spivey, Sr.
7,601,111 B2 10/2009 Sutherland et al.
7,699,215 B2 4/2010 Spivey, Sr.
7,743,944 B2 6/2010 Ho Fung et al.
7,743,968 B2 6/2010 Theelen
7,748,603 B2 7/2010 Fogle et al.
7,757,933 B2 7/2010 Dunn
7,793,779 B2 9/2010 Spivey, Sr. et al.
7,806,314 B2 10/2010 Sutherland
2003/0213263 A1 11/2003 Woog
2004/0050917 A1 3/2004 Smalley
2004/0074954 A1 4/2004 Fogle et al.
2005/0056658 A1 3/2005 Spivey
2005/0087592 A1 4/2005 Schuster
2005/0167478 A1 8/2005 Holley, Jr.
2006/0071058 A1 4/2006 Spivey, Sr.
2006/0169755 A1 8/2006 Spivey, Sr.
2006/0273143 A1 12/2006 Finch
2007/0039846 A1 2/2007 Spivey, Sr.
2007/0051781 A1 3/2007 Holley, Jr.
2007/0108261 A1 5/2007 Schuster
2007/0164091 A1 7/2007 Fogle et al.
2007/0181658 A1 8/2007 Sutherland
2007/0205255 A1 9/2007 Dunn
2007/0295789 A1 12/2007 Ho Fung
2007/1028442 12/2007 Holley
2008/0099544 A1 5/2008 Skolik
2008/0119344 A1 5/2008 Sutherland et al.
2009/0236408 A1 9/2009 Spivey, Sr.
2009/0255983 A1 10/2009 De Paula et al.
2010/0213249 A1 8/2010 Requena

FOREIGN PATENT DOCUMENTS

| | | | | |
|---|---|---|---|---|
| DE | 85 14 718.4 | | 6/1985 | |
| DE | 296 07 374 | U1 | 4/1996 | |
| DE | 201 12 228 | | 11/2002 | |
| DE | 2004 018 649 | | 4/2005 | |
| EP | 341089 | A2 * | 11/1989 | ..... 229/117.12 |
| EP | 0 412 226 | A1 | 2/1991 | |
| EP | 0473 266 | | 3/1992 | |
| EP | 1 612 157 | | 1/2006 | |
| FR | 1 494 239 | | 9/1967 | |
| FR | 2 579 175 | | 9/1986 | |
| JP | 8503187 | | 4/1996 | |
| JP | 2005507831 | | 3/2005 | |
| KR | 20-0356729 | Y1 | 7/2004 | |
| WO | 9410047 | | 5/1994 | |
| WO | WO/96/27538 | | 9/1996 | |
| WO | WO 99/28207 | | 6/1999 | |
| WO | WO/00/78618 | | 12/2000 | |
| WO | WO/01/66434 | | 9/2001 | |
| WO | 03037742 | A2 | 5/2003 | |
| WO | WO/03/037742 | | 5/2003 | |
| WO | WO/2005/080218 | | 9/2005 | |
| WO | WO/2005/123532 | | 12/2005 | |
| WO | WO/2007/089282 | | 8/2007 | |

OTHER PUBLICATIONS

International Search Report and Written Opinion—PCT/US2009/040424.

International Search Report for PCT application No. PCT/US2010/025178, mailed Sep. 2, 2010.

Written Opinion for PCT application No. PCT/US US2010/025178, mailed Sep. 2, 2010.

PCT/US2009/037642—International Search Report and Written Opinion Mar. 19, 2009.

Supplementary European Search Report for EP 10 74 6741 dated May 29, 2012.

* cited by examiner

CARTON WITH HANDLE

CROSS REFERENCE TO RELATED APPLICATION

This application claims the benefit of U.S. Provisional Application No. 61/208,463, filed Feb. 24, 2009, which is incorporated herein by reference in its entirety.

BACKGROUND OF THE DISCLOSURE

The present disclosure generally relates to cartons for holding containers. More specifically, the present disclosure relates to a carton having a handle.

SUMMARY OF THE DISCLOSURE

In one aspect, the instant disclosure is generally directed to a carton for containing a plurality of articles. The carton comprises a plurality of panels that extend at least partially around an interior of the carton. End flaps are respectively foldably attached to panels of the plurality of panels. The end flaps are overlapped with respect to one another and thereby at least partially form respective closed ends of the carton. A handle is formed by at least one handle panel in the top panel. The handle has features that extend into the closed ends to reinforce the carton.

In another aspect, the disclosure is generally directed to a carton for containing a plurality of articles. The carton comprises a plurality of panels that extends at least partially around an interior of the carton. The plurality of panels comprises a first top panel, a second top panel, a bottom panel, a first side panel, and a second side panel. The first top panel and the second top panel are at least partially overlapped to form a top wall of the carton. At least two end flaps are respectively foldably attached to respective panels of the plurality of panels, wherein the end flaps are overlapped with respect to one another and thereby at least partially form a closed end of the carton. The at least two end flaps comprise a first top end flap foldably connected to the first top panel and a second top end flap foldably connected to the second top panel. A handle comprises a first handle panel and a second handle panel. The first handle panel comprises a central portion in the top panel and an end portion in the first top end flap. The second handle panel comprises a first portion in the second top panel and a second portion in the second top end flap. The central portion of the first handle panel is attached to the first portion of the second handle panel and the end portion of the first handle panel is attached to the second portion of the second handle panel.

In another aspect, the disclosure is generally directed to a blank for forming a carton. The blank comprises a plurality of panels comprising a first top panel, a second top panel, a bottom panel, a first side panel, and a second side panel. At least two end flaps are respectively foldably attached to respective panels of the plurality of panels. The at least two end flaps are for being overlapped with respect to one another to at least partially close a first end of the carton erected from the blank. The at least two end flaps comprise a first top end flap foldably connected to the first top panel and a second top end flap foldably connected to the second top panel. Handle features are in the first top panel, the second top panel, the first top end flap, and the second top end flap. Wherein the handle features are for cooperating to at least partially define a handle in a carton erected from the blank. The handle features comprise a first handle panel and a second handle panel. The first handle panel comprises a central portion in the top panel and an end portion in the first top end flap. The second handle panel comprises a first portion in the second top panel and a second portion in the second top end flap. The central portion of the first handle panel is for attachment to the first portion of the second handle panel when the blank is formed into the carton. The end portion of the first handle panel is for attachment to the second portion of the second handle panel when the blank is formed into the carton.

In another aspect, the disclosure is generally directed to a method of assembling a carton. The method comprises providing a blank comprising a plurality of panels. The plurality of panels comprises a first top panel, a second top panel, a bottom panel, a first side panel, a second side panel, a first handle panel, and a second handle panel. A first top end flap is foldably connected to the first top panel. A second top end flap is foldably connected to the second top panel. The first handle panel comprises a central portion in the top panel and an end portion in the first top end flap. The second handle panel comprises a first portion in the second top panel and a second portion in the second top end flap. The method comprises forming a top wall of the carton by at least partially overlapping the first top panel and the second top panel. The forming the top wall comprises forming a handle. The forming the handle comprises attaching the central portion of the first handle panel to the first portion of the second handle panel, and attaching the end portion of the first handle panel being to the second portion of the second handle panel.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present invention generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present invention can accommodate articles of any shape. For the purpose of illustration and not for the purpose of limiting the scope of the invention, the following detailed description describes beverage containers (e.g., plastic beverage bottles) as disposed within the carton embodiments. In this specification, the terms "lower," "bottom," "upper" and "top" indicate orientations determined in relation to fully erected and upright cartons.

Figure 1:
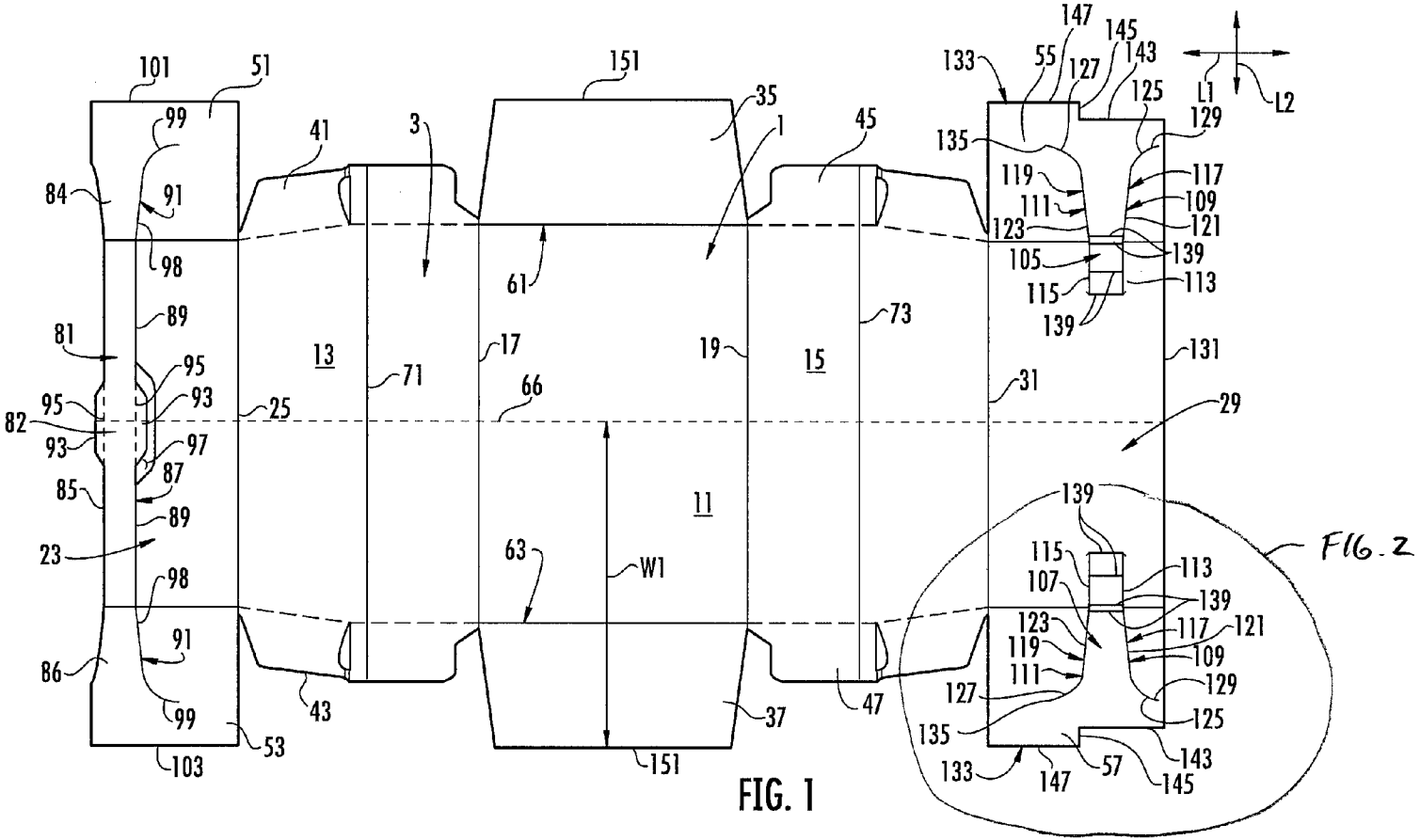
FIG. 1 is a plan view of a carton blank used to form an exemplary fully enclosed carton according to one embodiment of the disclosure.
Figure 2:
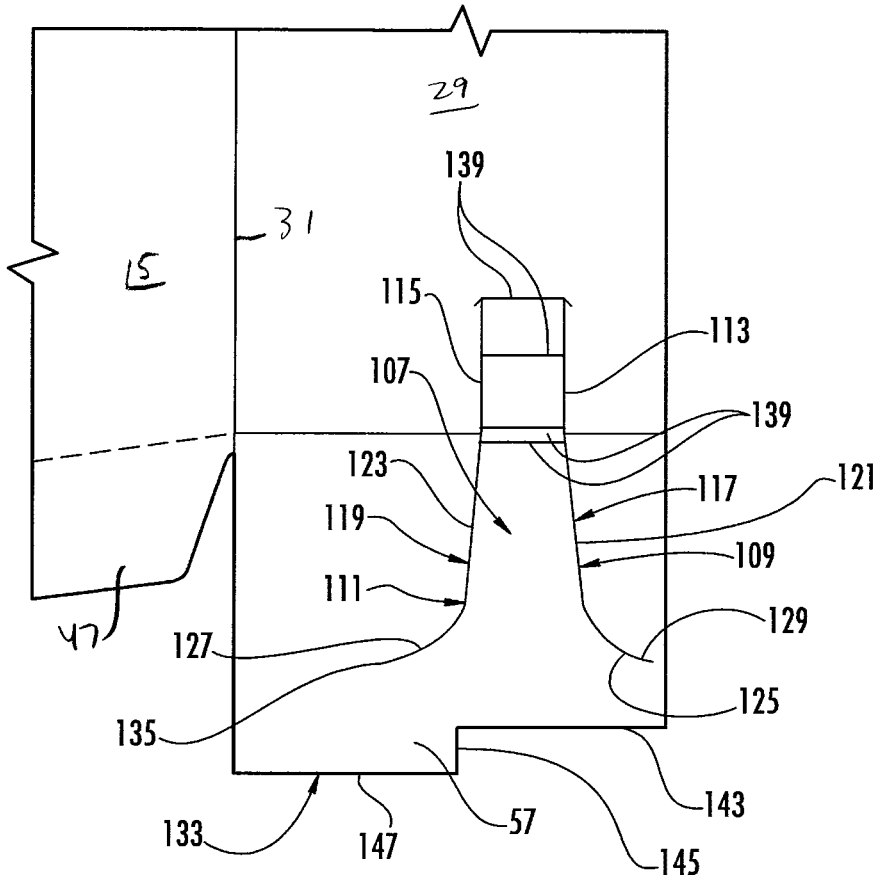
FIG. 2 is a plan view of a portion of a second top end panel of the carton blank of FIG. 1.
Figure 4A:
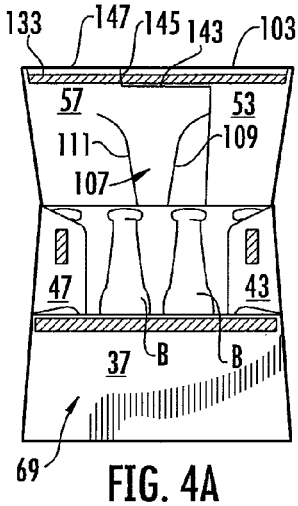
FIGS. 4A-4D are perspective views of the carton according to one embodiment of the disclosure.

FIG. 1 is a plan view of the exterior side 1 of a blank, generally indicated at 3, used to form a carton 5 (FIG. 4C) according to the exemplary embodiment of the invention. FIG. 2 is a plan view of an enlarged portion of the blank 3 of FIG. 1. The carton 5 can be used to house a plurality of articles such as containers B (FIG. 4A). The carton 5 has a handle, generally indicated at 7 (FIG. 4C), for grasping and carrying the carton. In the illustrated embodiment, the carton 5 is sized to house twenty-four containers B in a single layer in a 4×6 arrangement, but it is understood that the carton may be sized and shaped to hold containers of a different or same quantity in more than one layer and/or in different row/column arrangements (e.g., 1×6, 3×6, 3×4, 2×6, 2×6×2, 3×4×2, 2×9, etc.). In the illustrated embodiment, the containers B are bottles, but other types of containers can be used in the carton 5.

The blank 3 has a longitudinal axis L1 and a lateral axis L2. The blank 3 comprises a bottom panel 11 foldably connected to first and second side panels 13, 15 at lateral fold lines 17, 19, a first top panel 23 foldably connected to the first side panel 13 at a lateral fold line 25, and a second top panel 29 foldably connected to the second side panel 15 at a lateral fold line 31. The first and second top panels 23, 29 will at least partially overlap in the erected carton 5.

The bottom panel 11 is foldably connected to a first bottom end flap 35 and a second bottom end flap 37. The first side panel 13 is foldably connected to a first side end flap 41 and a second side end flap 43. The second side panel 15 is foldably connected to a first side end flap 45 and a second side end flap 47. The first top panel 23 is foldably connected to a first top end flap 51 and a third top end flap 53. The second top panel 29 is foldably connected to a second top end flap 55 and a fourth top end flap 57.

The end flaps 35, 41, 45, 51, 55 extend along a first marginal area of the blank 3, and are foldably connected at a first longitudinal fold line 61 that extends along the length of the blank. The end flaps 37, 43, 47, 53, 57 extend along a second marginal area of the blank 3, and are foldably connected at a second longitudinal fold line 63 that also extends along the length of the blank. The longitudinal fold lines 61, 63 may be, for example, substantially straight, or oblique at one or more locations to account for blank thickness or for other factors. When the carton 5 is erected, the end flaps 35, 41, 45, 51, 55 close a first end 67 of the carton, and the end flaps 37, 43, 47, 53, 57 close a second end 69 of the carton. In accordance with an alternative embodiment of the present invention, different flap arrangements can be used for closing the ends 67, 69 of the carton 5.

In the illustrated embodiment, the blank 3 includes a lateral fold line 71 extending across the side end flap 41, the first side panel 13, and the side end flap 43. Also, a lateral fold line 73 extends across the side end flap 45, the second side panel 15, and the side end flap 47. The lateral fold lines 71, 73 allow the side panels 13, 15 and the ends 67, 69 to taper inwardly from the bottom to the top of the carton 5. The fold lines 71, 73 can be otherwise shaped or positioned, or can be omitted, without departing from the disclosure.

The features that comprise the handle 7 include a first handle panel 81 that is in the first top panel 23 and the end flaps 51, 53. The first handle panel 81 has a central portion 82 in the top panel 23 and respective end portions 84,86 in a respective end flap 51, 53. The first handle panel 81 is defined by an edge 85 of the blank 3 extending in the lateral direction L2 and a tear line 87 spaced apart from the edge 85. The tear line 87 includes two central portions 89 in the top panel 23 and an end portion 91 in a respective end flap 51, 53. The central portion 82 of the handle panel 81 includes two handle flaps 93 foldably connected to the handle panel at respective lateral fold lines 95. An opening 97 in the top panel 23 is adjacent one of the handle flaps 93. Each of the end portions 91 of the tear line 87 include an oblique portion 98 extending from the central portion 89 and a curved portion 99 that extends from the oblique portion 98 and terminates in a respective end flap 51, 53 at a location spaced from a longitudinal edge 101, 103 of the end flap.

In the illustrated embodiment, the features that form the handle 7 include a second handle panel 105 and a third handle panel 107. The second handle panel 105 is in the second top panel 29 and the second top end flap 55. The third handle panel 107 is in the second top panel 29 and the end flap 57. Each of the second handle panel 105 and third handle panel 107 include identical features, and like or similar reference numbers are used to indicate like or similar features. The second handle panel 105 and third handle panel 107 could have different features or one or both of the second and third handle panels could be omitted without departing from the disclosure.

The second handle panel 105 is defined by two spaced-apart tear lines 109, 111. Each tear line 109, 111 includes a first portion 113, 115 in the second top panel 29 and a second portion 117, 119 in the second top end flap 55. In the illustrated embodiment, the first portions 113, 115 are generally parallel and extend in the lateral direction L2 of the blank 3. The second portions 117, 119 include respective oblique portions 121, 123 that extend from the fold line 61 to curved ends 125, 127 in the second top end flap 55. The curved end 125 terminates at a location 129 adjacent a lateral edge 131 of the blank 3 and spaced in from a longitudinal edge 133 of the second top end flap 55. The curved end 127 terminates at a location 135 spaced in from the longitudinal edge 133 of the second top end flap 55. In the illustrated embodiment, the second handle panel 105 includes respective longitudinal fold lines 139 that extend between the spaced-apart tear lines 109, 111.

The third handle panel 107 is defined by two spaced-apart tear lines 109, 111. Each tear line 109, 111 includes a first portion 113, 115 in the second top panel 29 and a second portion 117, 119 in the fourth top end flap 57. In the illustrated embodiment, the first portions 113, 115 are generally parallel and extend in the lateral direction L2 of the blank 3. The second portions 117, 119 include respective oblique portions 121, 123 that extend from the fold line 63 to curved ends 125, 127 in the fourth top end flap 57. The curved end 125 terminates at a location 129 adjacent a lateral edge 131 of the blank 3 and spaced in from a longitudinal edge 133 of the fourth top end flap 57. The curved end 127 terminates at a location 135 spaced in from the longitudinal edge 133 of the fourth top end flap 57. In the illustrated embodiment, the second handle panel 105 includes respective longitudinal fold lines 139 that extend between the spaced-apart tear lines 109, 111.

In the illustrated embodiment, each of the end flaps 55, 57 includes a cutout 143 adjacent to a shoulder 145. The longitudinal edge 133 of each of the end flaps 55, 57 comprises a laterally-outer portion 147 adjacent the shoulder that is spaced laterally outward from the cutout 143. In the illustrated embodiment, the laterally-outer portion 147 of the longitudinal edge 133 of each of the end flaps 55, 57 is spaced apart from the longitudinally-extending centerline CL of the blank 3 by a distance W1. The longitudinal edge 151 of each of the bottom end flaps 35, 37 is spaced apart from the centerline CL by the distance W1. The cutout 143 of each of the top end flaps 55, 57 is spaced apart from the centerline CL of the blank 3 by a distance less than the distance W1. The longitudinal edges 101, 103 of the top end flaps 51, 53 are spaced-apart from the centerline CL of the blank by the distance W1.

Figure 3B:
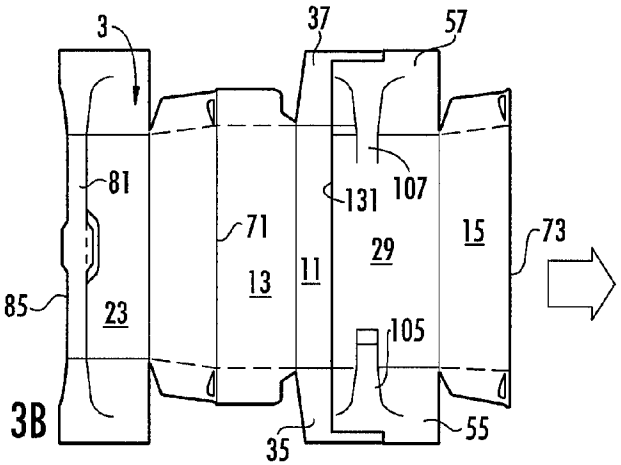
FIGS. 3A-3D are views showing one exemplary method of folding of the carton blank to form the open-ended sleeve.
Figure 3D:
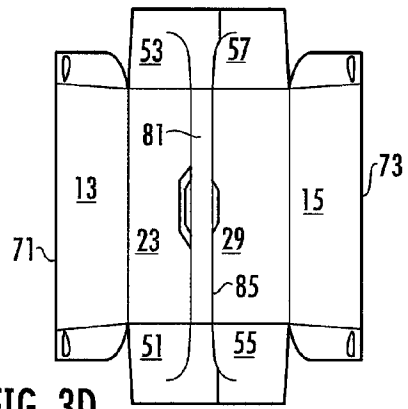
Figure 3A:
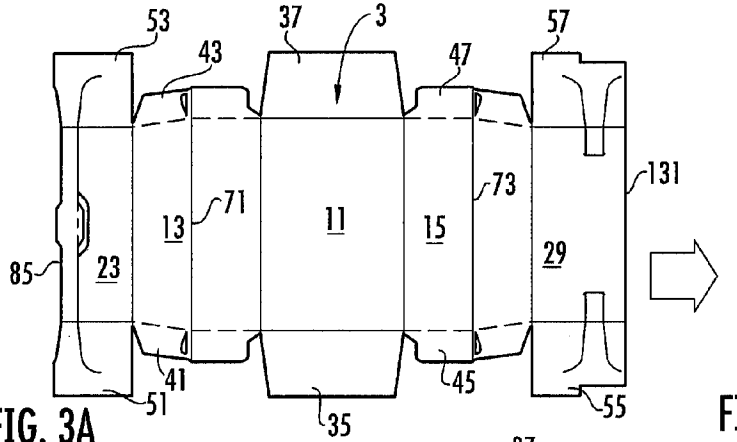
Figure 3C:
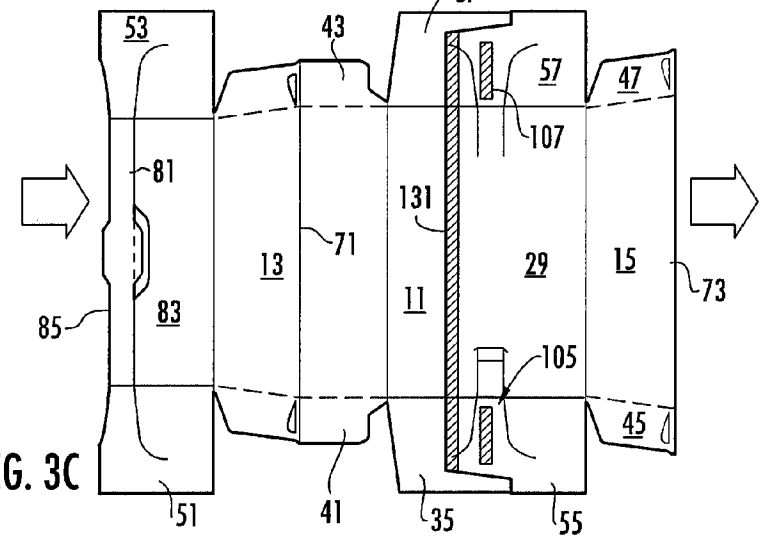

An exemplary method of erecting the carton 50 is discussed in detail below. At various stages of the erecting process, glue or other adhesive can be applied to the upper or exterior side of a portion of the second top panel 29 and respective portions of the end flaps 55, 57 as indicated in FIG. 3C. Glue can also be applied to portions of the exterior surfaces of the side end flaps 41, 43 and bottom end flaps 35, 37. Further, glue may be alternatively applied to other flaps and/or panels without departing from the disclosure. As shown in FIG. 3A, the blank 3 is first positioned with the exterior surface 1 down. The blank is folded at the lateral fold line 73 to position the second top panel 29 in face-to-face contact with the bottom panel 11 (FIG. 3B). Next, as indicated in FIG. 3C, glue is applied to the portion of the exterior surface 1 of the second top panel 29 and the end flaps 55, 57. Next, as shown in FIG. 3D, the blank 3 is further assembled by folding at lateral fold line 71 so that the first top panel 23 overlaps the second top panel 29. The first handle panel 81 is in face-to-face contact with a portion of the second top panel 29, the second handle panel 105, and the third handle panel 107. The end portion 84 of the first handle panel 81 in the first top end flap 51 will be adhered to the portion of the second handle panel 105 in the second top end flap 55, and the end portion 86 of the first handle panel 81 in the third top end flap 53 will be adhered to the portion of the third handle panel 107 in the fourth top end flap 57. In the illustrated embodiment, the central portion 82 of the first handle panel 81 will be free from attachment to the portion of the second top panel 29 that extends laterally between the second and third handle panels 105, 107.

Figure 4B:
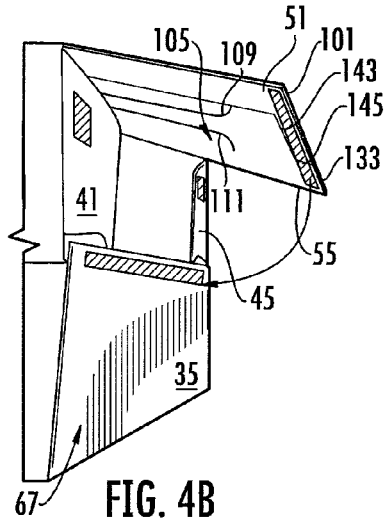

The partially assembled blank of FIG. 3D can be assembled into a open-ended sleeve so that containers B can be loaded into the sleeve. As shown in FIGS. 4A and 4B, after loading the containers B, the ends 67, 69 of the carton can be closed by at least partially overlapping and adhering the end flaps 35, 41, 45, 51, 55 at one end of the carton and at least partially overlapping and adhering the end flaps 37, 43, 47, 53, 57 at the other end of the carton. The overlapped top end flaps at each end (e.g., 53, 57 at end 69) are downwardly folded and secured to the bottom end flap (e.g., 37) and side end flaps 43, 47 at the same end. The notch 143 in the end flap 57 allows the outer marginal portion of the end flap 53 to be secured to the bottom end flap 37. The ends 67, 69 of the carton 5 could be closed by other closing steps and features without departing from the disclosure.

Figure 4C:
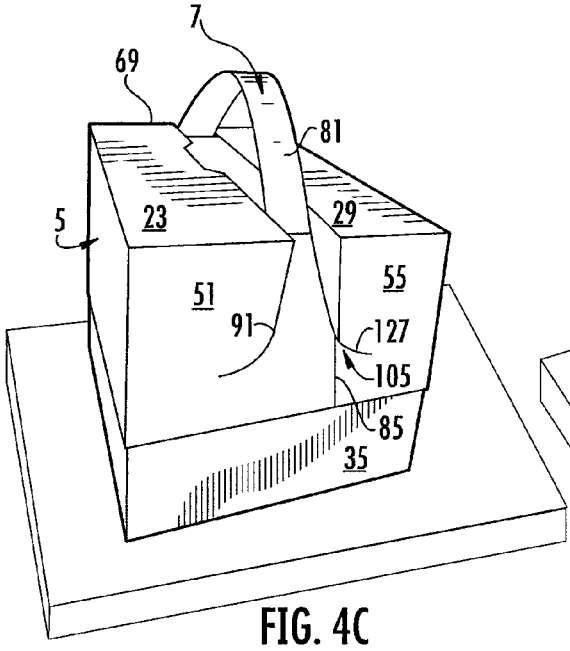
Figure 4D:
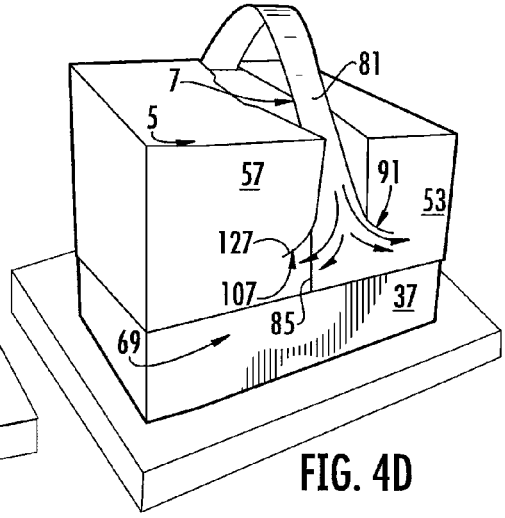

As shown in FIGS. 4C and 4D, the handle 7 is activated by separating the first handle panel 81 from the first top panel 23 by tearing along tear line 87. By lifting the first handle panel 81, the central portion 82 of the first handle panel 81 is separated from the portion of the second top panel 29 between the second and third handle panels 105, 107. Also, the second and third handle panels 105, 107 are separated from the second top panel 29 and the end flaps 55, 57. The wide base of each of the end portions of the handle 7 allows forces in the ends of the carton to be more evenly distributed across a larger area of the carton ends when the carton 5 is lifted at the handle 7.

In the illustrated embodiment, the handle 7 comprises a handle panel 151 that comprises a single layer of material (e.g. single-ply portion) in the middle portion of the handle panel (e.g., the central portion 82 of the first handle panel 81 between the second handle panel 105 and the third handle panel 107) and two layers of material at the ends of the handle panel (e.g. the two-ply portions) where the portions of the central panel 82 and the end portions 84, 86 of the first handle panel 81 overlap respective ones of the second handle panel 105 and the third handle panel 107. The handle 7 could have other features and could include additional reinforcing layers or portions without departing from the disclosure. For example, the handle could include an additional third reinforcing layer as is disclosed in U.S. patent application Ser. No. 11/671,126 filed Feb. 5, 2007, the entire contents of which are incorporated by reference herein for all purposes.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above. The blanks can also be laminated to or coated with one or more sheet-like materials at selected panels or panel sections.

In accordance with the exemplary embodiment of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue. The term "glue" is intended to encompass all manner of adhesives commonly used to secure carton panels or flaps in place.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extends at least partially around an interior of the carton, the plurality of panels comprises a first top panel, a second top panel, a bottom panel, a first side panel, and a second side panel, the first top panel and the second top panel being at least partially overlapped to form a top wall of the carton;

at least two end flaps respectively foldably attached to respective panels of the plurality of panels, wherein the end flaps are overlapped with respect to one another and thereby at least partially form a closed end of the carton, the at least two end flaps comprise a first top end flap foldably connected to the first top panel and a second top end flap foldably connected to the second top panel; and a handle comprising a first handle panel and a second handle panel, the first handle panel comprises a central portion in the first top panel and an end portion in the first top end flap, the second handle panel comprises a first portion in the second top panel and a second portion in the second top end flap, the central portion of the first handle panel being attached to the first portion of the second handle panel and the end portion of the first handle panel being attached to the second portion of the second handle panel, the second handle panel is at least partially defined by two spaced apart tear lines, the two spaced-apart tear lines each comprise a first portion in the second top panel and a second portion in the second top end flap, the second portion of each of the spaced-apart tear lines comprises an oblique portion that extends from a respective first portion and a curved portion that extends from a respective oblique portion, and the second handle panel comprises a plurality of fold lines that extend between the two spaced-apart tear lines, one of the plurality of fold lines foldably connecting the second handle panel and the second top panel.

2. The carton of claim 1, wherein the handle comprises a single-ply portion that comprises a portion of the central portion of the first handle panel that is free from attachment to the second top panel, and a two-ply portion that comprises a portion of the central portion of the first handle panel that is attached to the first portion of the second handle panel and the end portion of the first handle panel that is attached to the second portion of the second handle panel.

3. The carton of claim 1, wherein the first handle panel is at least partially defined by a tear line that comprises a central portion in the first top panel that at least partially defines the central portion of the first handle panel, and a second portion in the first top end flap that at least partially defines the end portion of the first handle panel.

4. The carton of claim 3, wherein the first handle panel is at least partially defined by an edge of the first top panel, the tear line being spaced apart from the edge.

5. The carton of claim 4, wherein the central portion of the tear line is generally parallel to the edge of the first top panel, and the second portion of the tear line comprises an oblique portion that extends from the central portion and a curved portion that extends from the oblique portion.

6. The carton of claim 2 wherein:

the closed end is a first closed end;

the end flaps are first end flaps that are overlapped with respect to one another to form the first closed end;

the carton comprises at least two second end flaps respectively foldably attached to respective panels of the plurality of panels, wherein the second end flaps are overlapped with respect to one another to form a second closed end of the carton, the at least two second end flaps comprise a third top end flap foldably connected to the first top panel and a fourth top end flap foldably connected to the second top panel;

the end portion of the first handle panel is a first end portion and the first handle panel comprises a second end portion in the third top end flap; and the handle comprises a third handle panel, the third handle panel comprises a first portion in the second top panel and a second portion in the fourth top end flap, the central portion of the first handle panel being attached to the first portion of the third handle panel and the second end portion of the first handle panel being attached to the second portion of the third handle panel.

7. The carton of claim 6, wherein the first handle panel is at least partially defined by a tear line that comprises a central portion in the first top panel that at least partially defines the central portion of the first handle panel, a second portion in the first top end flap that at least partially defines the first end portion of the first handle panel, and a third portion in the third top end flap that at least partially defines the second end portion of the first handle panel.

8. The carton of claim 7, wherein the third handle panel is at least partially defined by two spaced-apart tear lines, each of the tear lines defining the third handle panel comprises a first portion in the second top panel and a second portion in the fourth top end flap.

9. The carton of claim 8, wherein the two-ply portion comprises a portion of the central panel that is attached to the first portion of the third handle panel and the second end portion of the first handle panel that is attached to the second portion of the third handle panel.

10. The carton of claim 9, wherein the single-ply portion of the handle extends between the second handle panel and the third handle panel, and the two-ply portion further comprises a portion of the central panel of the first handle panel that is attached to the first portion of the third handle panel and the second end portion of the first handle panel that is attached to the second portion of the third handle panel.

11. The carton of claim 1, wherein the one of the plurality of fold lines is an end fold line forming an end of the second handle panel.

12. A blank for forming a carton comprising:

a plurality of panels comprising a first top panel, a second top panel, a bottom panel, a first side panel, and a second side panel;

at least two end flaps respectively foldably attached to respective panels of the plurality of panels, the at least two end flaps are for being overlapped with respect to one another to at least partially close a first end of the carton erected from the blank, the at least two end flaps comprise a first top end flap foldably connected to the first top panel and a second top end flap foldably connected to the second top panel; and handle features in the first top panel, the second top panel, the first top end flap, and the second top end flap, wherein the handle features are for cooperating to at least partially define a handle in a carton erected from the blank, the handle features comprise a first handle panel and a second handle panel, the first handle panel comprises a central portion in the first top panel and an end portion in the first top end flap, the second handle panel comprises a first portion in the second top panel and a second portion in the second top end flap, the central portion of the first handle panel being for attachment to the first portion of the second handle panel when the blank is formed into the carton, and the end portion of the first handle panel being for attachment to the second portion of the second handle panel when the blank is formed into the carton, the second handle panel is at least partially defined by two spaced apart tear lines, the two spaced-apart tear lines each comprise a first portion in the second top panel and a second portion in the second top end flap, the second portion of each of the spaced-apart tear lines comprises an oblique portion that extends from a respective first portion and a curved portion that extends from a respective oblique portion, and the second handle panel comprises a plurality of fold lines that extend between the two spaced-apart tear lines, one of the plurality of fold lines foldably connecting the second handle panel and the second top panel.

13. The blank of claim 12, wherein the first handle panel is at least partially defined by a tear line that comprises a central portion in the first top panel that at least partially defines the central portion of the first handle panel, and a second portion in the first top end flap that at least partially defines the end portion of the first handle panel.

14. The blank of claim 13, wherein the first handle panel is at least partially defined by an edge of the first top panel, the tear line being spaced apart from the edge.

15. The blank of claim 14, wherein the central portion of the tear line is generally parallel to the edge of the first top panel, and the second portion of the tear line comprises an oblique portion that extends from the central portion and a curved portion that extends from the oblique portion.

16. The blank of claim 12 wherein:

the closed end is a first closed end;

the end flaps are first end flaps that are overlapped with respect to one another to form the first closed end of the carton erected from the blank;

the blank comprises at least two second end flaps respectively foldably attached to respective panels of the plurality of panels, wherein the second end flaps are for being overlapped with respect to one another to form a second closed end of the carton erected from the blank, the at least two second end flaps comprise a third top end flap foldably connected to the first top panel and a fourth top end flap foldably connected to the second top panel;

the end portion of the first handle panel is a first end portion and the first handle panel comprises a second end portion in the third top end flap; and the handle features comprise a third handle panel, the third handle panel comprises a first portion in the second top panel and a second portion in the fourth top end flap, the central portion of the first handle panel is for being attached to the first portion of the third handle panel when the carton is erected from the blank, and the second end portion of the first handle panel is for being attached to the second portion of the third handle panel when the carton is erected from the blank.

17. The blank of claim 16, wherein the first handle panel is at least partially defined by a tear line that comprises a central portion in the first top panel that at least partially defines the central portion of the first handle panel, a second portion in the first top end flap that at least partially defines the first end portion of the first handle panel, and a third portion in the third top end flap that at least partially defines the second end portion of the first handle panel.

18. The blank of claim 17, wherein the third handle panel is at least partially defined by two spaced-apart tear lines, each of the tear lines defining the third handle panel comprises a first portion in the second top panel and a second portion in the fourth top end flap.

19. A method of assembling a carton comprising:

providing a blank comprising a plurality of panels comprising a first top panel, a second top panel, a bottom panel, a first side panel, a second side panel, a first handle panel and a second handle panel, and a first top end flap foldably connected to the first top panel, and a second top end flap foldably connected to the second top panel, the first handle panel comprises a central portion in the first top panel and an end portion in the first top end flap, the second handle panel comprises a first portion in the second top panel and a second portion in the second top end flap, the second handle panel is at least partially defined by two spaced apart tear lines, the two spaced-apart tear lines each comprise a first portion in the second top panel and a second portion in the second top end flap, the second portion of each of the spaced-apart tear lines comprises an oblique portion that extends from a respective first portion and a curved portion that extends from a respective oblique portion, and the second handle panel comprises a plurality of fold lines that extend between the two spaced-apart tear lines, one of the plurality of fold lines foldably connecting the second handle panel and the second top panel;

forming a top wall of the carton by at least partially overlapping the first top panel and the second top panel, the forming the top wall comprises forming a handle, the forming the handle comprises attaching the central portion of the first handle panel to the first portion of the second handle panel, and attaching the end portion of the first handle panel being to the second portion of the second handle panel.

20. The method of claim 19, wherein the forming the handle comprises forming a single-ply portion of the handle that comprises a portion of the central panel of the first handle panel that is free from attachment to the second top panel, and forming a two-ply portion of the handle that comprises a portion of the central portion of the first handle panel that is attached to the first portion of the second handle panel and the end portion of the first handle panel that is attached to the second portion of the second handle panel.

21. The method of claim 19, wherein the first handle panel is at least partially defined by a tear line that comprises a central portion of the first top panel that at least partially defines the central portion of the first handle panel, and a second portion in the first top end flap that at least partially defines the end portion of the first handle panel, the forming the handle comprises separating the first handle panel from the first top panel and the first top end flap by tearing along the tear line.

22. The method of claim 19, wherein the forming the handle comprises separating the second handle panel from the first top panel and the second top end flap by tearing along the two spaced-apart tear lines.

23. The method of claim 19, further comprising loading the carton with a plurality of articles and overlapping the first top end flap and the second top end flap to close a first end of the carton.

24. The method of claim 20, wherein the blank further comprises a third top end flap and a fourth top end flap, the end portion of the first handle panel is a first end portion and the first handle panel comprises a second end portion in the third top end flap, the handle features comprise a third handle panel that comprises a first portion in the second top panel and a second portion in the fourth top end flap, the forming the handle comprises attaching the central portion of the first handle panel to the first portion of the third handle panel and attaching the second end portion of the first handle panel to the second portion of the third handle panel.

25. The method of claim 20, further comprising grasping the single-ply portion of the handle and lifting the single-ply portion above the top wall.

26. The method of claim 25, wherein when the single-ply portion of the handle is lifted, the two-ply portions are moved inwardly toward the interior of the carton.

* * * * *